United States Patent [19]

Salmonsen et al.

[11] 4,125,084

[45] Nov. 14, 1978

[54] FIRE EXTINGUISHER ALARM

[75] Inventors: Greg C. Salmonsen; David C. Pfieffer, both of Owatonna, Minn.

[73] Assignee: Muckle Manufacturing Division Builders Iron Products, Inc., Owatonna, MN

[21] Appl. No.: 830,625

[22] Filed: Sep. 6, 1977

[51] Int. Cl.[2] ..... G08B 13/14

[52] U.S. Cl. ..... 116/99; 169/51; 222/39

[58] Field of Search ..... 116/70, 112, 99, 77; 169/85, 99, 51; 222/39, 41, 180; 340/280

[56] References Cited

U.S. PATENT DOCUMENTS

| | | | |
|---|---|---|---|
| 2,754,498 | 7/1956 | Lavelle | 340/280 |
| 2,965,890 | 12/1960 | Robillard | 340/280 |
| 3,185,127 | 5/1965 | Chedister | 116/86 |
| 3,520,368 | 7/1970 | Hayes | 116/106 X |
| 3,893,095 | 7/1975 | DeJong | 169/23 X |
| 3,899,105 | 8/1977 | Fegley | 222/180 X |
| 4,034,697 | 7/1977 | Russell | 116/86 X |

*Primary Examiner*—Daniel M. Yasich

*Attorney, Agent, or Firm*—Schroeder, Siegfried, Ryan, Vidas & Steffey

[57] ABSTRACT

This invention relates to a fire extinguisher alarm for use with a removable fire extinguisher. The alarm includes a support bracket mounted in an enclosure housing the fire extinguisher or in proximity with a mounted fire extinguisher. The support bracket has a pivoted plate adapted to engage the base of the mounted fire extinguisher. The plate includes a trigger arm, which when pivoted, engages a audible alarm formed by a pressurized gas can and horn, tilting the can relative to the horn to permit the release of gas under pressure to operate the horn.

10 Claims, 4 Drawing Figures

FIRE EXTINGUISHER ALARM

FIELD AND BACKGROUND OF INVENTION

This invention relates to fire extinguisher alarms and more particularly to an alarm adapted to be associated with or mounted in an enclosure housing a removable fire extinguisher to give a warning when the fire extinguisher is removed from its normal location.

Fire extinguishers inherently are mounted to be available for public access when needed. Because of such access, they are subject to vandalism and theft such as to be inoperative or unavailable when needed. Such interference is minimized by alarms associated with fire extinguishers which operate when the fire extinguisher is removed from its mounting. In the prior art, a variety of such alarms are included with enclosures and operate upon opening of the enclosure door. Others are interconnected in the mounting handle for the fire extinguisher and operate an electric circuit when the handle is removed from its mounting. In other arrangements, the fire extinguisher is associated with or rests on a switch to operate the alarm. The associated circuitry in such alarms is connected to existing power circuits or to battery operated circuits. In other devices a mechanical spring wound actuator is employed to operate the alarm. The electric circuits connected to existing wiring are susceptible to malfunction when the power goes off. Similarly, battery operated circuits are subject to normal current drain from the battery such that the alarm may not be operable when needed. The mechanical spring wound actuators require special housings amd special keys to wind the same, and normally will not provide sufficient signal to prevent tampering.

SUMMARY OF PRESENT INVENTION

This invention relates to an alarm for a fire extinguisher which is adapted to be mounted in an enclosure for the fire extinguisher or in proximity therewith and is actuated upon removal of the fire extinguisher from its normal mounting position. The alarm is a self-contained pressurized gas source operating a horn, the gas source having a valve which is operated to release the gas from its container upon tilt of a flexible neck which is coupled to the horn. The improved alarm is mounted on a bracket positioned in the enclosure supporting the fire extinguisher or in proximity therewith to contact the bracket. It includes a pivoted bar or plate having an actuating spring biasing the same which pivots the same away from the bracket. The plate includes a trigger flange which is aligned with the pressurized gas container and when pivoted will contact the container to tilt the same and will release gas operating the horn. The fire extinguisher which may be positioned in the enclosure or in proximity with the alarm, rests on the pivoted flange and holds the same in an inoperative position against the spring bias until the fire extinguisher is removed from its mounting. The bracket includes a removable mounting for the horn and gas assembly and a protective enclosure to prevent tampering with the same. A suitable key type flange may be inserted into the bracket to prevent movement of the spring biased and pivoted plate with the trigger flange thereon whenever it is desired to remove the fire extinguisher for servicing and maintenance check. The improved alarm is a self-contained unit with a pressure source which is replaceable and which provides sufficient gas pressure to operate the horn or alarm to audibly indicate the removal of the fire extinguisher and the presence of a fire requiring removal of the same.

DESCRIPTION OF THE INVENTION

Figure 1:
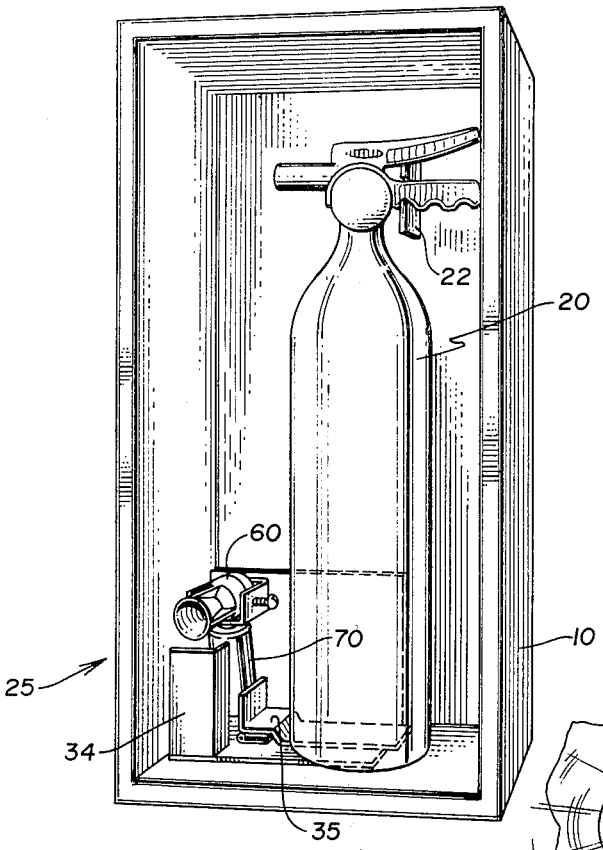
FIG. 1 is a perspective view of an enclosure mounting a fire extinguisher and including the improved alarm.

The improved alarm for a fire extinguisher is shown in FIG. 1 as applied to an enclosure housing a fire extinguisher. The enclosure or box-like structure 10 is shown as having an open face, although it will be understood that it may have a closable door thereon. A fire extinguisher, indicated generally at 20, is positioned within the enclosure or case and is suitably mounted therein through a bracket or a hook 22 affixed to the case. The improved alarm, which is indicated generally at 25, is positioned in the lower portion of the enclosure.

Figure 2:
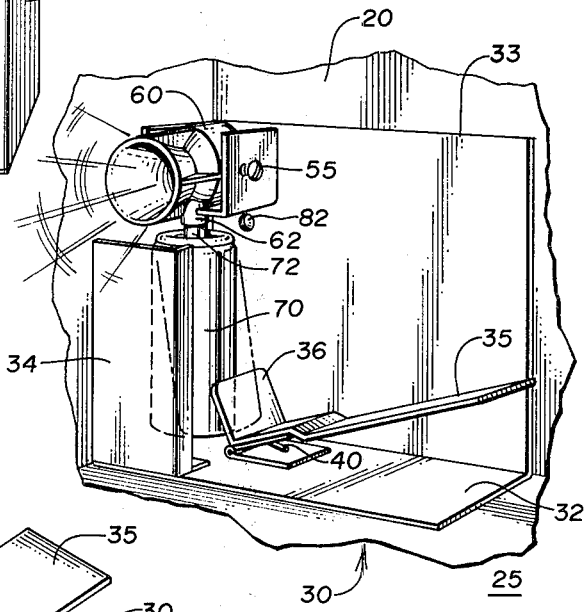
FIG. 2 is a perspective view of the alarm apart from the fire extinguisher and showing the tilt of the operating flange to operate the horn.
Figure 3:
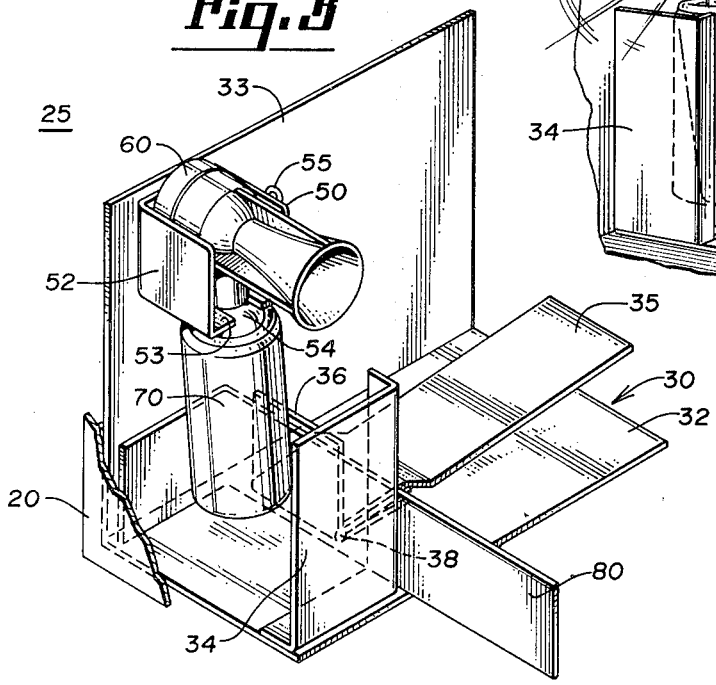
FIG. 3 is a perspective view of the alarm with the key type flange inserted therein to prevent operation of the alarm during servicing of the fire extinguisher.

As will be best seen in FIGS. 2 and 3, the alarm 25 is comprised of a bracket member 30 which is preferably made of a sheet metal and bent to have a flat base portion 32 with upstanding back section 33 or wall and a partial wall 34 at the front edge of the same which is suitably secured thereto such as by welding. An "L" shape flange member 35 is positioned on the base portion of the bracket member with the flange member having a bend to form an elongated plate portion and a trigger portion 36 normal thereto. The flange member 35 has a hinge 38 welded thereto which hinge is in turn welded to the bracket member. Hinge 38 includes a biasing spring 40 in the same. As will be later noted, the spring 40 is designed to bias the flange member 35 so that the plate portion is urged away from the base portion 32 of the bracket member. It will normally be retained in position due to the presence and weight of the fire extinguisher which sits thereon or bear against the flange member.

The back or wall portion 33 of the bracket member mounts a support member 50 which is suitably welded to the wall portion 33 and includes sides 52 designed to hold and support a horn or alarm 60 with a bottom flange 53 having a recess 54 therein through which the connection of the horn extends. The horn is operated by a can of pressurized gas 70, such as Freon, which can has a flexible neck portion 72 with a suitable valve therein, not shown. This valve controls the release of gas under pressure from the can with flexing of the neck portion 72. The flexible neck 72 of the can has a suitable threaded exterior, not shown, which threads into an inlet hub 62 of the horn to mount the pressurized can on the horn. The horn or alarm is secured between the walls 52 of the support by means of a metal screw 55. The recess 54 in the bottom flange 53 of the support provides clearance for the neck of the can as it is tilted relative to the horn in the support to release gas and operate the horn. Support 50 mounts the horn and pressurized gas can in alignment with the trigger flange 36 of the pivoted flange member 35 such that whenever the fire extinguisher 20 is removed from the enclosure, the pivoted flange will be allowed to pivot (see FIG. 2) and to bear against the side of the can 70. This will tilt the can relative to the horn 60 allowing release of the gas therein to operate the horn.

The pressurized Freon can or an equivalent pressurized gas source is a one shot source and when tripped will exhaust and audibly sound the horn to clearly indicate removal of the fire extinguisher and in the event of fire, the presence of the same. It may be readily replaced by unscrewing the can from the horn and inserting a new pressurized can thereon.

As will be seen in FIG. 3, whenever it is desired to service the fire extinguisher and not operate the horn, an "L" shaped key member 80 may be inserted from in front of the enclosure around the front wall portion 34 and the pressurized can to bear against the back wall 33 and the wall of the enclosure 20. This will prevent the pivoted flange member 35 from pivoting when the fire extinguisher is released and prevent operation of the alarm.

The improved alarm may be easily installed in the existing fire extinguisher enclosures by means of a metal screw which threads through an aperture 82 in the wall portion 33 of the bracket member 30. This will secure the alarm in an enclosure housing a fire extinguisher in a position so that the pivoted flange member 35 may be positioned below and designed to be contacted by the base of the fire extinguisher when mounted on its normal support 22 within the enclosure. Thereafter, the alarm will be operative to indicate removal of the fire extinguisher, whether for proper use or for pilfering, by allowing the pivoted flange to pivot to engage the can 70 of pressurized gas operating the valve therein and allowing the gas to escape through the horn, sounding an audible signal. The improved alarm has the advantage over electrical system or battery operated systems in that it is not dependent upon the condition of the battery or the presence of electricity in a circuit. It will continuously remain in a condition to be activated and, when used, may be readily replaced with a new pressurized can insuring an adequate source for the alarm at all times.

Figure 4:
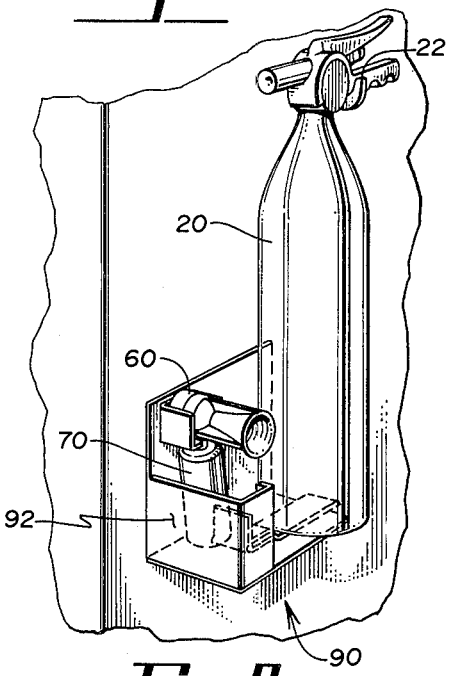
FIG. 4 is a perspective view of the alarm associated with a fire extinguisher which is not mounted in an enclosure.

The embodiment shown in FIGS. 4 for the alarm is substantially identical with that which in FIGS. 1, 2 and 3 with the exception that it does not require the fire extinguisher to be mounted in an enclosure. Thus, in FIG. 4, the bracket member 90 is adapted to be mounted beneath a fire extinguisher, indicated generally at 20, which is positioned in a support bracket 22 and hung on a wall without an enclosure. The bracket member 90 is adapted to be mounted on the wall beneath the fire extinguisher and in a position to contact the same. Bracket member 90 is substantially identical with the bracket member 30 shown in the embodiments of FIGS. 1, 2, and 3 with the exception that the flat base portion 32 has the upstanding back portion 33 and front wall portion 34 and in addition, a side wall portion 92. The back portion 33 and the wall portions 92 and 34 define an enclosure for the can of pressurized gas 70, and the horn 60 is mounted on the support member 50 attached to the wall portion 33 of the bracket member. When the bracket member 90 is positioned below the fire extinguisher 20 and mounted on the wall beneath the same, the flange member 35 of the bracket member will be positioned beneath the fire extinguisher and held in position against the tension of the biasing spring 40. In this embodiment, the alarm is operated in the same manner. The removal of the fire extinguisher from the support bracket member will allow the pivoted flange member 35 to pivot, tilting the pressurized gas can relative to the horn and sounding the alarm. Similarly, the "L" shaped key member 80 may be inserted into the bracket member between the flange member 35 and the pressurized can with the edge of the same bearing against the wall 92 of the bracket member to prevent operation of the alarm whenever it is desired to remove the extinguisher for servicing.

It will be recognized that the location of the support member and pivoted flange and the direction of the pivot of the hinged flange member 35 within the bracket member may be interchanged from one side to another and operated in the manner described above.

In considering this invention it should be remembered that the disclosure is illustrative only, and the scope of the invention should be determined by the appended claims.

We claim:

1. An alarm adapted to be associated with a removable fire extinguisher to indicate removal of the same, comprising: a bracket member having a flat base portion and upstanding wall portions normal thereto, said bracket member being adapted to be mounted relative to a fire extinguisher so that the flat base portion is positioned adjacent the base of the extinguisher; a pivoted spring biased flange member having a flat plate and a trigger portion normal thereto mounted on the flat base portion of the bracket member, said flat plate of said flange member being positioned parallel to and adjacent the flat base portion of the bracket member when a fire extinguisher is so mounted that its base rests on the flat plate, said flat plate of the flange member being urged away from the flat base portion of the bracket member when the fire extinguisher is removed; a support mounted on one of the wall portions of the bracket member; and an alarm horn having a self-contained pressurized gas supply coupled thereto mounted in said support, said trigger portion of said flange member being aligned with and adapted to pivot against the gas supply with pivot of the spring biased flange member away from the flat base portion of the bracket member to release gas from the gas supply to sound the horn.

2. The alarm of claim 1 in which the trigger portion of the flange member contacts the gas supply to displace the same and operate a valve therein.

3. The alarm of claim 1 in which said wall portions of said bracket member enclose the gas supply.

4. The alarm of claim 1 in which the support therein mounts the horn and the gas supply.

5. The alarm of claim 4 in which the gas supply is a can of pressurized gas having a flexible spout with a valve means therein operative to release gas from the can upon bending of the flexible spout, and in which the alarm horn is threaded onto the flexible spout to be engaged by the trigger portion of the flange member to tilt the pressurized can and operate the horn.

6. The alarm of claim 5 in which the pivoted flange member is a plate member bent along its extent to define the flat plate and trigger portion normal thereto and in which the flat plate is pivoted through a hinge at the bend with spring means positioned in the hinge to bias the flange member away from the base portion of the bracket member.

7. The alarm of claim 6 in which the support includes means for mounting the alarm horn with the pressurized gas can connected thereto, and including a recess means in the support for permitting tilting movement of the pressurized can relative to the horn to bend the flexible spout.

8. An alarm adapted to be mounted in an enclosure housing a removable fire extinguisher, comprising: a bracket member having a base portion adapted to be mounted within the enclosure and with the base portion positioned below and in near proximity with the base of the fire extinguisher mounted within the enclosure; a pivoted flange member mounted on the base portion of the bracket member and held in position overlying the base portion of the bracket member when the fire extinguisher mounted within the enclosure contacts said flange member; spring means included in the pivot of the flange member for biasing the flange member away from the base portion of the bracket member; an upstanding trigger arm connected to the flange member and movable therewith; and an alarm system mounted on the bracket member adjacent the trigger arm, said alarm system including a horn and a can of pressurized gas pivotally connected thereto which is adapted to be operated upon pivot of the flange member with removal of the fire extinguisher causing the trigger arm to contact and displace the pressurized can to operate the horn.

9. The alarm of claim 8 and including an "L" shaped bracket means positioned in the bracket member bearing against the trigger arm of the pivoted flange member to prevent tilt of the pressurized can upon removal of the fire extinguisher from the enclosure.

10. The alarm of claim 8 in which the bracket member includes means for securing the same within the enclosure.

* * * * *